US005435569A

United States Patent [19]

Zilliox

[11] Patent Number: 5,435,569

[45] Date of Patent: Jul. 25, 1995

[54] COMBINED WATER PISTOL AND SCORING TARGET

[76] Inventor: Kent Zilliox, 361 Halsey Ave., San Jose, Calif. 95128

[21] Appl. No.: 86,056

[22] Filed: Jun. 30, 1993

[51] Int. Cl.[6] ..... A63B 67/00

[52] U.S. Cl. ..... 273/349; 222/79

[58] Field of Search ..... 273/349, 86 R, 85 H; 446/225, 176, 473; 141/18; 222/79

[56] References Cited

U.S. PATENT DOCUMENTS

| | | | |
|---|---|---|---|
| 2,759,731 | 8/1956 | Quinn | 273/101 |
| 3,342,492 | 9/1967 | Barrett | 273/349 |
| 3,477,723 | 11/1969 | Djedda | 273/349 |
| 3,572,712 | 3/1971 | Vick | 273/86 |
| 4,040,622 | 8/1977 | Sinnott | 273/86 R |
| 4,077,629 | 3/1978 | Chestney | 273/101 |
| 4,135,559 | 1/1979 | Barnby | 141/18 |
| 4,165,073 | 8/1979 | Kellerstrass | 273/101 |
| 4,223,894 | 9/1980 | Fabricant | 273/349 |
| 4,412,680 | 11/1983 | Zorn | 273/85 H |
| 4,743,030 | 5/1988 | Auer et al. | 273/349 |
| 5,080,625 | 1/1992 | Huffhines | 446/225 |

OTHER PUBLICATIONS

*Larami* Super Soaker 20 from Toys"R"Us ad.
Super Soaker 40 from Toys"R"Us ad.
Super Soaker 50 from Toys"R"Us ad.
*Larami* Super Soaker 100 from Toys"R"Us ad.
Super Soaker 200 from Toys"R"Us ad.
*Larami* Super Soaker M. D. S. from Toys"R"Us ad.

*Primary Examiner*—Mark S. Graham
*Attorney, Agent, or Firm*—James J. Leary

[57] ABSTRACT

A combined water pistol and target for simulated combat games. A target mountable on the water pistol provides a quantitative measure of how many times and how accurately it has been hit during the course of a simulated battle to help determine the winner. Water striking the target runs down into a "lifeline" tube which can determine when a player has been "killed" during simulated combat. A float ball aids in visualizing the accumulated score. One version has a planar target which registers hits which strike the front surface of the target. A second version has a bull's-eye with concentric circles so that more-accurate hits score higher. A third version is a three dimensional target which registers hits on the target from a full 360 degrees around the player. A fourth version has a 180 degree three dimensional target. The lifeline may include a series of tubes aligned side by side. When the first tube fills, the water starts to cascade into the second tube and so on. This gives a visual indication of the accumulated score which is quick and easy to evaluate. The lifeline can be equipped with a trigger jamming mechanism which disables the water pistol from firing when the lifeline tube is full. The mechanism has a float ball which rises in the tube as it fills with water. When the float ball reaches the top of the tube it jams the trigger, which disables the water pistol from firing. When this happens, the player is officially "dead" for the remainder of the game.

12 Claims, 19 Drawing Sheets

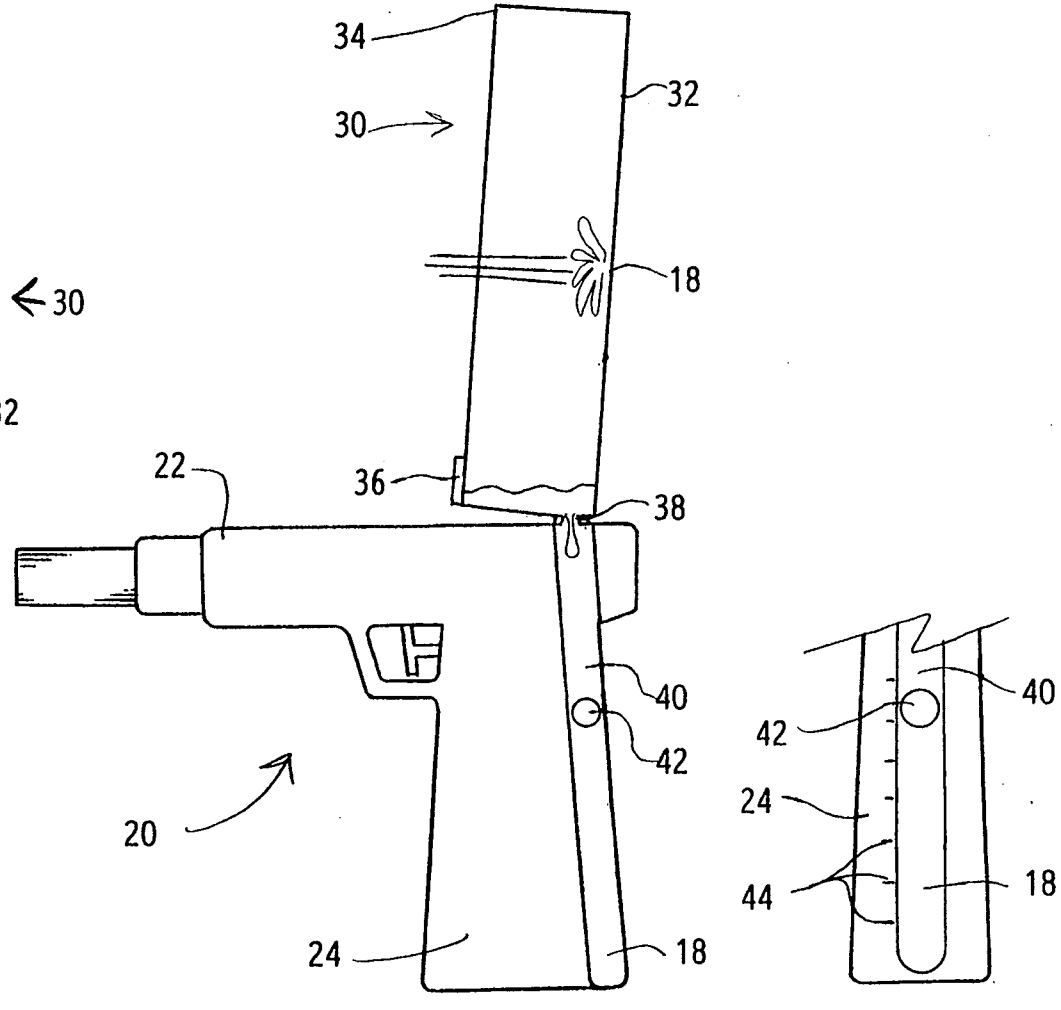
FIGURE 1
FIGURE 3
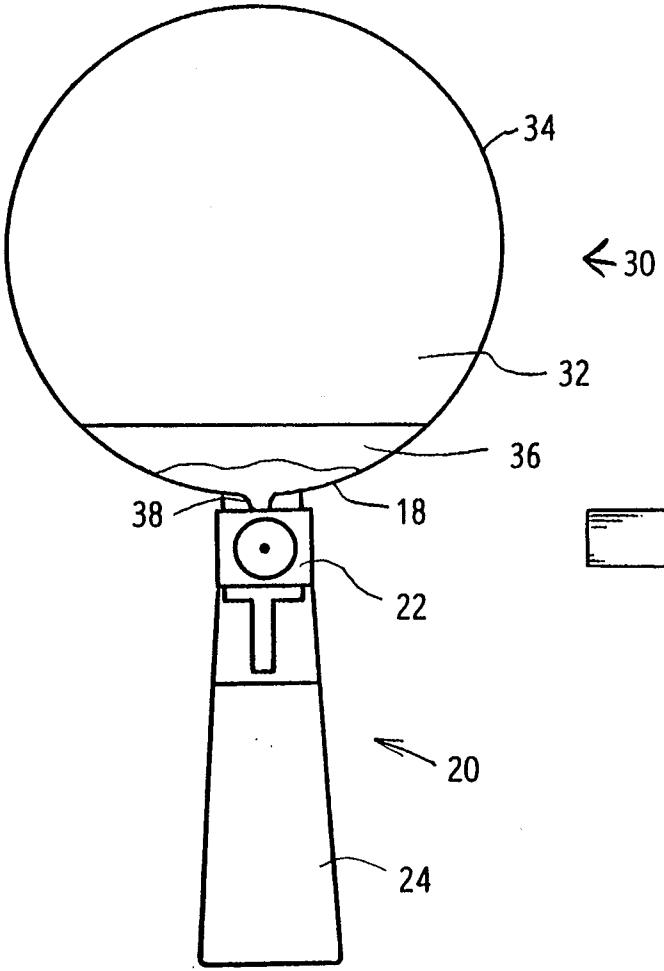
FIGURE 2

COMBINED WATER PISTOL AND SCORING TARGET

FIELD OF THE INVENTION

The present invention relates to toys and amusement devices. More particularly, it relates to a squirt gun or water pistol which is combined with a scoring target. The scoring target can be used as a stand-alone target or attached to the water pistol for playing simulated combat games.

BACKGROUND OF THE INVENTION

Squirt guns and water pistols are perennially popular toys for children and, more and more, for adults as well. Recent improvements in the area of squirt guns have caused an upsurge in their popularity as toys. These improvements include the introduction of high volume water pistols with high capacity water tanks. One popular version of the high volume water pistol is the "Super Soaker" from Larami Corp. which pumps out high velocity streams of water. Another recent improvement in the sophistication of water pistols, which is described in U.S. Pat. No. 4,492,318, is a water pistol where the stream of water can be directed anywhere in 360 degrees.

Water pistols can be used for target shooting, but their most popular use is in simulated combat games where a number of players try to shoot one another with their water pistols. While these games are a lot of fun, they lack any quantitative measure of who has won the combat. After a particularly fierce or evenly contested battle it is often very difficult to determine who is the most (or least) soaked. One attempt to make it easier to score water pistol battles was the introduction of a nonstaining dye which can be loaded into the water pistols so that it is easier to tell where a player has been hit during combat. Another attempt is described in U.S. Pat. No 4,743,030 which shows a combat game set that includes a motorized water pistol and a special multilayer vest which indicates where it has been hit with water. That way, ordinary water can be used for the game instead of a special dye. While these attempts do make it easier to see who has been hit and who hasn't, it is still very much a qualitative judgement to determine who has been the actual winner of the combat game.

A number of quantitative or semi-quantitative targets have been devised for measuring the accuracy of a player's marksmanship with a water pistol. U.S. Pat. Nos. 1,526,341; 1,551,899; 2,759,731; 3,336,030; 3,342,492; 3,362,713; and 3,572,712 show water gun targets which are designed for use in shooting galleries in amusement parks. U.S. Pat. Nos. 1,273,746; 2,832,173; 3,434,717; 3,843,127; 4,040,622; 4,077,629; 4,135,559; 4,165,076; 4,223,894; 4,412,680 and 5,080,625 show water gun targets which are suitable for home use. Without exception, these water gun targets are designed as stationary targets and would not be suitable for a mobile simulated combat game.

SUMMARY OF THE INVENTION

In keeping with the foregoing discussion, the objective of the present invention is to provide a combined water pistol and target for use in mobile simulated combat games. The target can be permanently fixed to the water pistol or removably mounted so that the water pistol and target can be used separately. It is another objective to provide a target which provides a cumulative measure of how many times and how accurately it has been hit during the course of a simulated battle to help determine the winner of the simulated combat. It is a further objective to provide a "lifeline" feature in the scoring target which will determine when a given player has been "killed" during simulated combat by measuring the accumulated number of hits sustained by the player during the course of the combat. An additional objective is to provide a mechanism which will disable a player's water pistol from firing when the player has exceeded his or her "lifeline" so that they must drop out of the combat.

In accordance with these objectives, the present invention takes the o form of a target which is mountable on a water pistol. Water which strikes the target runs down into a "lifeline" tube which gives a cumulative measure of the number of times and the accuracy with which the target has been hit. The lifeline tube may contain a float ball to aid in visualizing the accumulated score. One version of the target is a planar target which registers hits which strike the front surface of the target. A second version of the target has a bull's-eye with concentric circles so that more accurate hits score higher in the game. A third version is a three dimensional target which registers hits on the target from a full 360 degrees around the player. A fourth version is a three dimensional target designed to register hits on the target from a 180 degree arc in front of the player.

To aid in quantifying the score of the game the lifeline may include a series of tubes aligned side by side. When the first tube fills, the water starts to cascade into the second tube and so on. This gives a visual indication of the accumulated score which is quick and easy to evaluate. In addition the lifeline can be equipped with a shutoff mechanism which disables the water pistol from firing when the lifeline tube is full. One mechanism for this function has a float ball which rises in the tube as it fills with water. When the float ball reaches the top of the tube it interferes with the trigger of the water pistol, which disables it from firing. When this happens, the player is officially "dead" for the remainder of the game. Other objects and advantages of the invention will no doubt occur to those skilled in the art upon reading and understanding the following detailed description along with the accompanying drawings.

BRIEF DESCRIPTION OF THE DRAWINGS

FIG. 1 shows a side view of a first embodiment of the invention.

FIG. 2 shows a front view of the first embodiment.

FIG. 3 shows a partial rear view of the first embodiment.

DETAILED DESCRIPTION OF THE INVENTION

Figure 4:
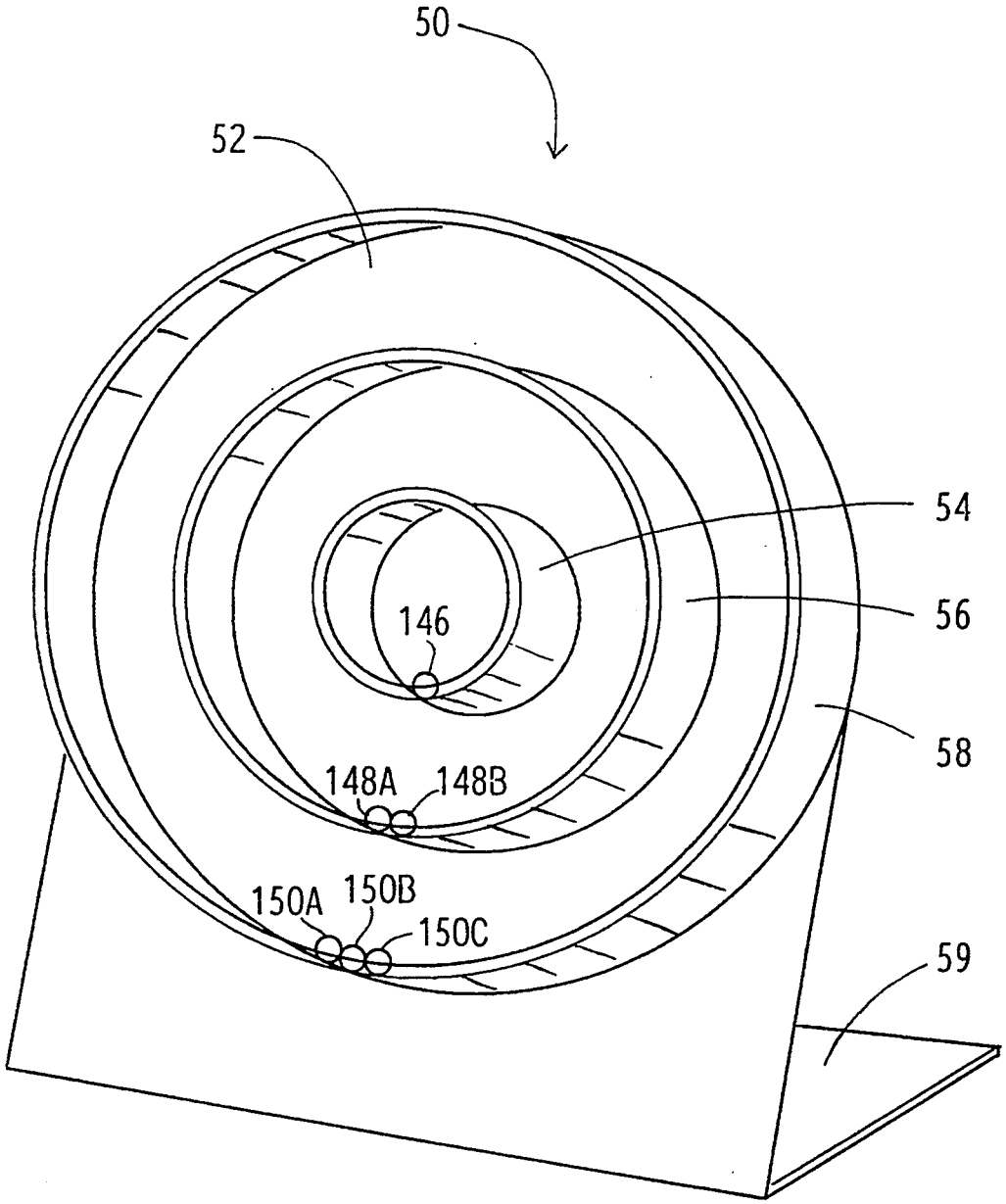
FIG. 4 shows a bull's-eye scoring target for use with the invention.

FIGS. 1, 2 and 3 show side, front and rear views of the first embodiment of the present invention. A water pistol 20 has a scoring target 30 mounted to it. The target 30 can be mounted above the water pistol 20, as illustrated, or it can be mounted beside it, below it or in any other convenient position. The target 30 could even be made in an annulus surrounding the barrel 22 of the-water pistol 20. Positioned above the gun, the target can be made transparent and given cross hairs so that it can double as a gun sight as well as a target. The target 30 in this embodiment has a largely planar target surface 32. A raised rim 34 surrounding the target surface 32 and a splash skirt 36 at the bottom edge of the rim 34 help to contain water that strikes the target surface 32. A fluid passage 38 at the bottom of the target 30 communicates with the "lifeline" tube 40. The transparent lifeline tube 40 is preferably made integral with the handle 24 of the water pistol 20. Alternately, the lifeline tube 40 can be made external so that it hangs behind, below or beside the water pistol 20. When water 18 strikes the target surface 32 it runs into the fluid passage 38 and down into the lifeline tube 40. Optionally, a one-way valve or a trap can be added in the fluid passage 38 or the lifeline tube 40 to prevent back flow or spilling of water which collects in the lifeline tube 40. The amount of water which collects in the lifeline tube 40 gives a quantitative measure of how many times and how accurately the target 30 has been hit. This is because the amount of water that enters the lifeline tube 40, and hence the score, will be affected by the number of times that the target 30 is hit and by the amount of water that hits it each time. A float ball 42 inside the lifeline tube 40 aids in visualizing the accumulated score. As shown in FIG. 3, graduation marks 44 can be made on or beside the lifeline tube 40 to help quantify the score.

Figure 5:
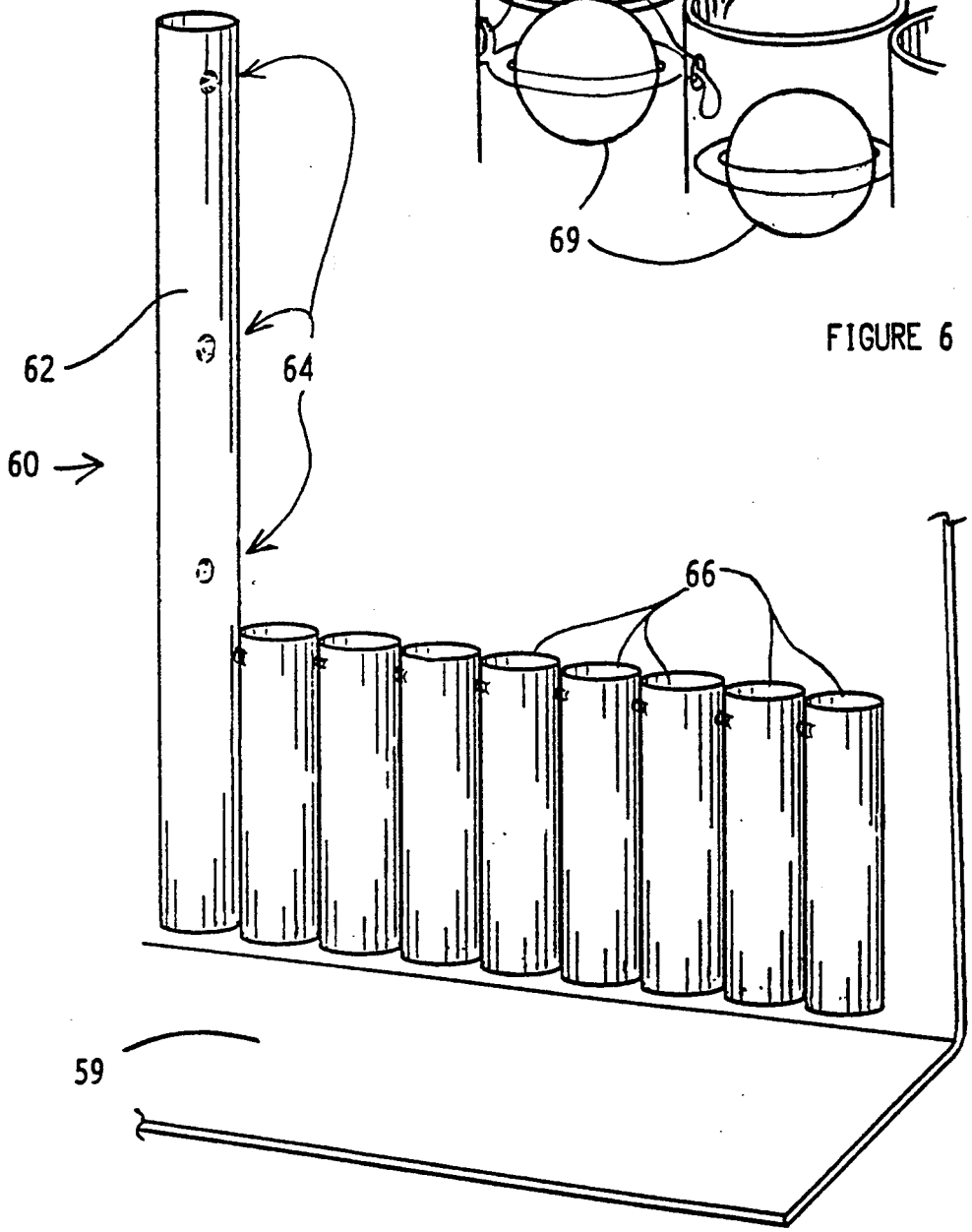
FIG. 5 is a rear view of a target showing a cascade lifeline scoring system.

FIG. 4 shows a variation of the scoring target, which has a bull's-eye with concentric circles so that more accurate hits score higher in the game. The bull's-eye target 50 has a largely planar target surface 52. Each of the concentric circles is surrounded by a raised circular rim 54, 56, 58 to capture the water which strikes the target within each of the circles. The water that strikes the target 50 collects in a lifeline tube 60, which is shown in FIG. 5, to give a quantitative score. In order to rate the concentric circles differently, a fraction of the water that strikes each circle proportional to the weight given to that part of the target is allowed to run into the lifeline tube 60. In the illustrated example: In the center or "bull's-eye" of the target 50 all of the water which strikes the inner circle will run down into a single hole 146 connected to the lifeline 60. In the middle circle there are two holes 148 A&B, one hole 148A connects to the lifeline 60 and the other 148B is a drain hole which does not connect to the lifeline 60. Approximately one half of the water which strikes the middle circle will run into the lifeline. In the outer circle there are three holes 150 A, B & C, one hole 150A connects to the lifeline 60 and the other two 150 A&C are drain holes which do not connect to the lifeline 60. Approximately one third of the water which strikes the outer circle will run into the lifeline 60. Thus, hits on the bull's-eye will count full value in the scoring, hits on the middle circle will count one half, and hits on the outer circle will count one third. This rewards the players for their accuracy as well as the volume of their shots.

Figure 23:
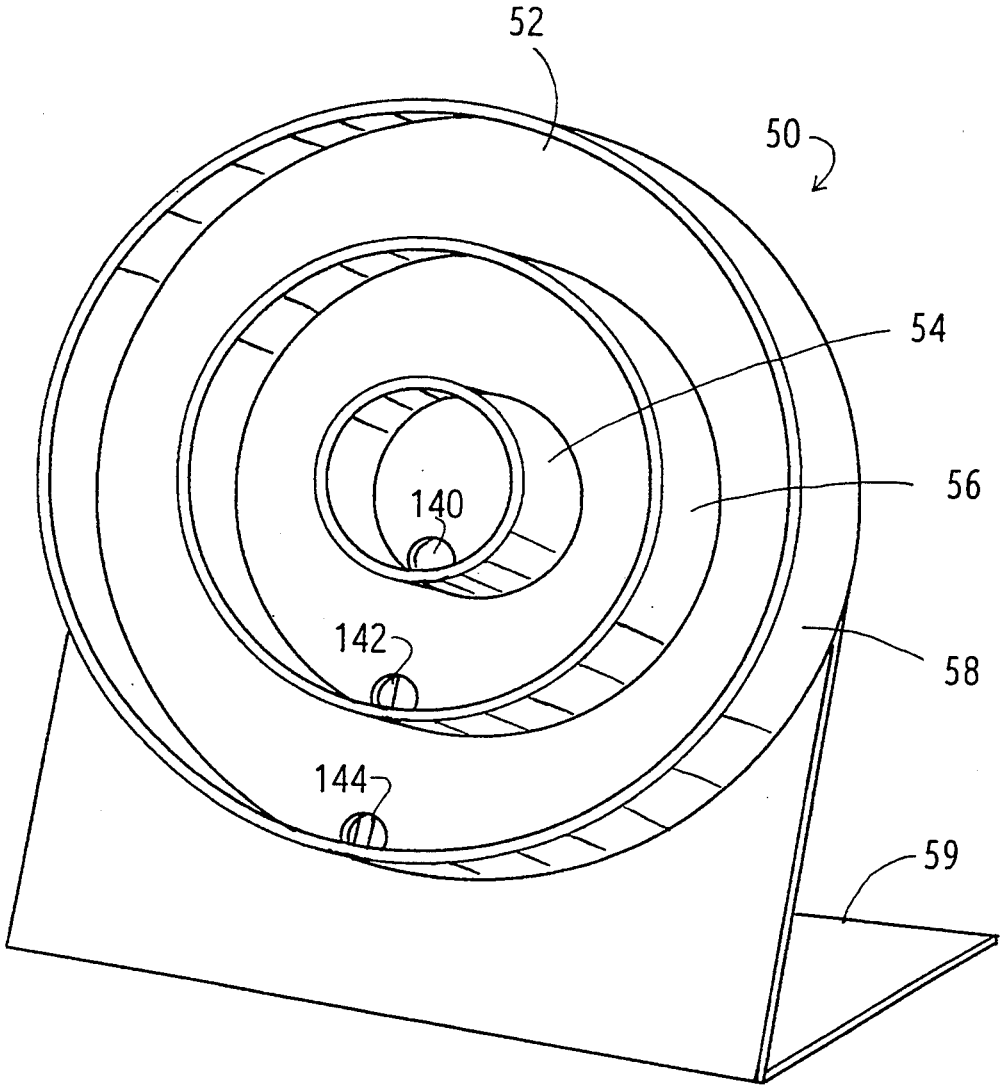
FIG. 23 shows an alternate version of the bull's-eye scoring target.
Figure 24:
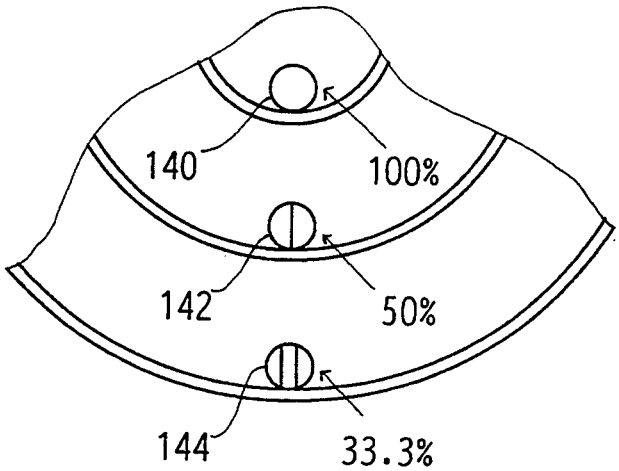
FIG. 24 shows an detail view of the metering holes in the bull's-eye scoring target.

FIGS. 23 and 24 show an alternate version of the bull's-eye scoring target 50. This target, as shown in FIG. 23, is the same as the embodiment of FIG. 4 except for the means of differentially scoring the concentric circles. As shown in the detail drawing in FIG. 24: In the center of the target 50 all of the water which strikes the inner circle runs down into a single hole 140 connected to the lifeline tube 60 (see FIG. 5). In the middle circle there is a single hole 142 which is divided into two passages, one passage connects to the lifeline 60 and the other is a drain which does not connect to the lifeline 60. Approximately one half of the water which strikes the middle circle will run into the lifeline 60. In the outer circle there is a single hole 144 which is divided into three passages, one passage connects to the lifeline 60 and the other two passage are drains which do not connect to the lifeline 60. Approximately one third of the water which strikes the outer circle will run into the lifeline 60. Thus, hits on the bull's-eye will count full value in the scoring, hits on the middle circle will count one half, and hits on the outer circle will count one third.

A variation on this theme would be to make a target with different regions of varying point score value other than concentric circles. For instance a target could be made with illustrations of various big game animals. Hits on a small animal could count full value because of the accuracy required and hits on a larger animal could count one half, one third or one quarter, etc.

Figure 6:
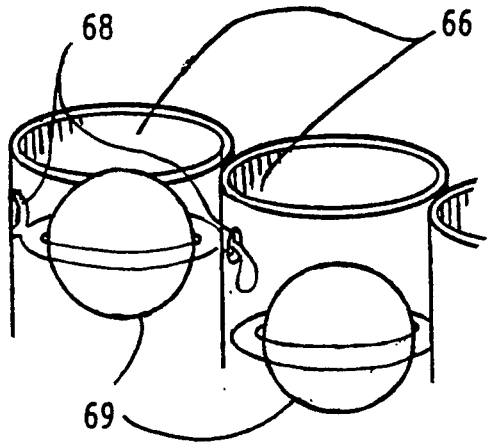
FIG. 6 is a close-up view of the cascade lifeline scoring system.

FIG. 5 shows a rear view of the lifeline 60 for the bull's-eye target 50 shown in FIG. 4. The lifeline 60 is made up of one long tube 62 which has holes 64 that connect to each of the concentric circles on the target 50. The water that strikes the target 50 runs through the holes 64, into the tube 62 and collects at the bottom of the tube 62. If desired, the long tube 62 can be coupled to a series of tubes 66 aligned side by side. This increases the volume of the lifeline 60 and gives an easy to read visual indication of the accumulated score. As shown in the close up view in FIG. 6, each of the tubes 66 is connected to the next by a hole or a spillway 68 near the tops of the tubes. When the first tube fills, the water starts to cascade into the second tube and so on. Each of the tubes may contain a float ball or other shaped float 69 to help in visualizing the score. Though it has been illustrated with the bull's-eye target 50, this variation of the lifeline 60 can also be used with any of the other target designs described herein.

Another way of making different regions of a target count for different scores is to connect each region to a different lifeline tube with a cross sectional area inversely proportional to the value of the score. Because it would take more water to fill the larger tube to the same height, hits to the region it is connected to would count for less. The total score would be the sum of the heights of the water in all of the tubes.

Figure 7:
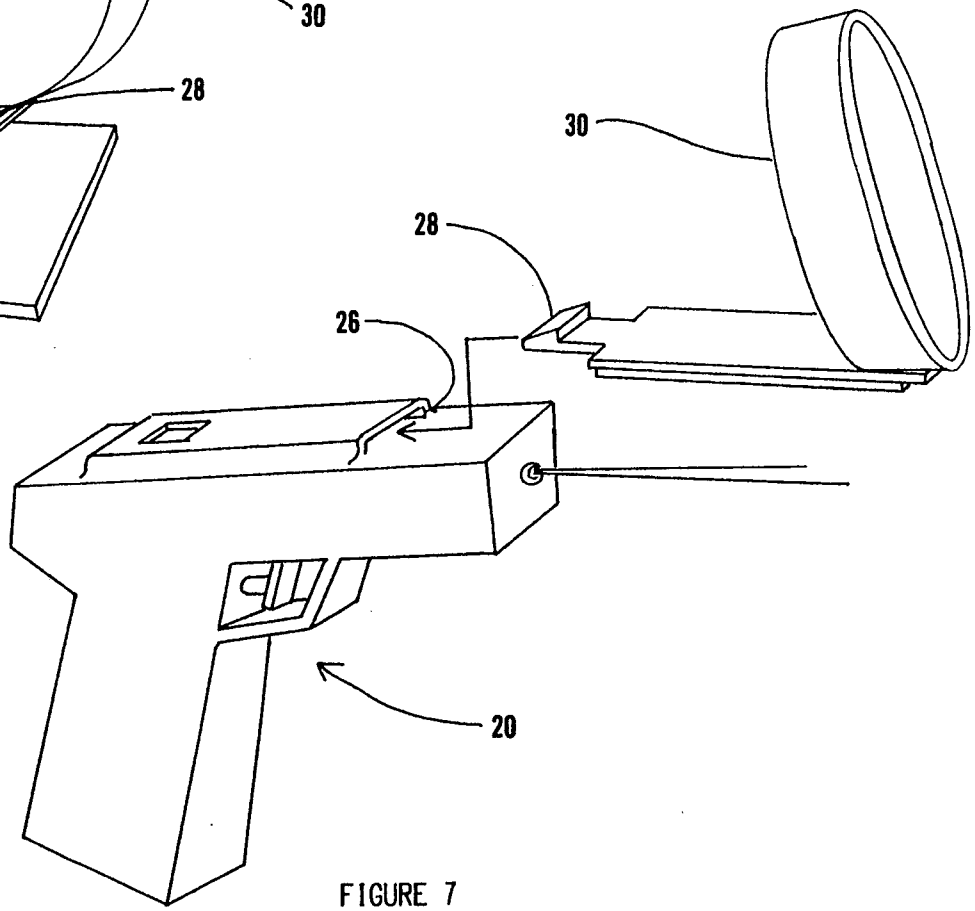
FIG. 7 shows an attachment mechanism for attaching the scoring target to a water pistol.
Figure 8:
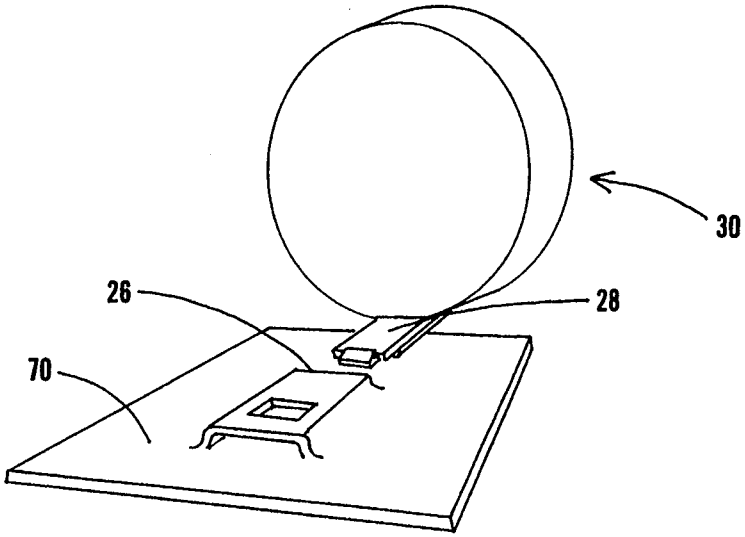
FIG. 8 shows an optional base which can be attached to the scoring target for use a stationary target.

Each of the targets described in this patent can be made permanently attached to a water pistol 20, as in FIG. 1, or they can be made freestanding with their own base 59 as shown in FIG. 4. Another variation is to make the targets detachable from the water pistols, as illustrated in FIGS. 7 and 8. As shown in FIG. 7, the water pistol 20 is made with a female connector 26 and the target 30 is made with a male connector 28 which snaps in to attach the target to the pistol. The target 30 can be detached from the water pistol 20 and attached to a target base 70, as shown in FIG. 8, to use the invention in target shooting mode instead of simulated combat, such as when a child wishes to play alone. In combat mode the player with the lowest score showing on their lifeline will be the winner, but, of course, in target shooting mode the player with the highest score will be the winner.

Figure 10:
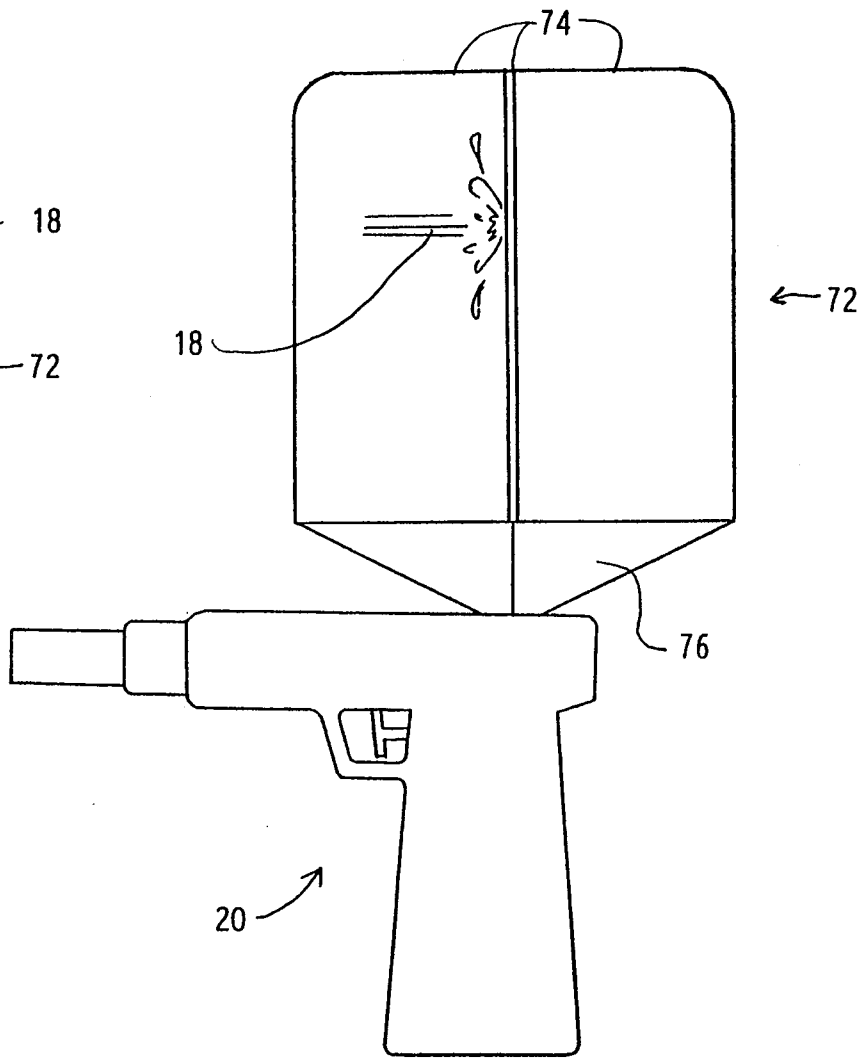
FIG. 10 shows a side view of the invention with a three dimensional target.
Figure 9:
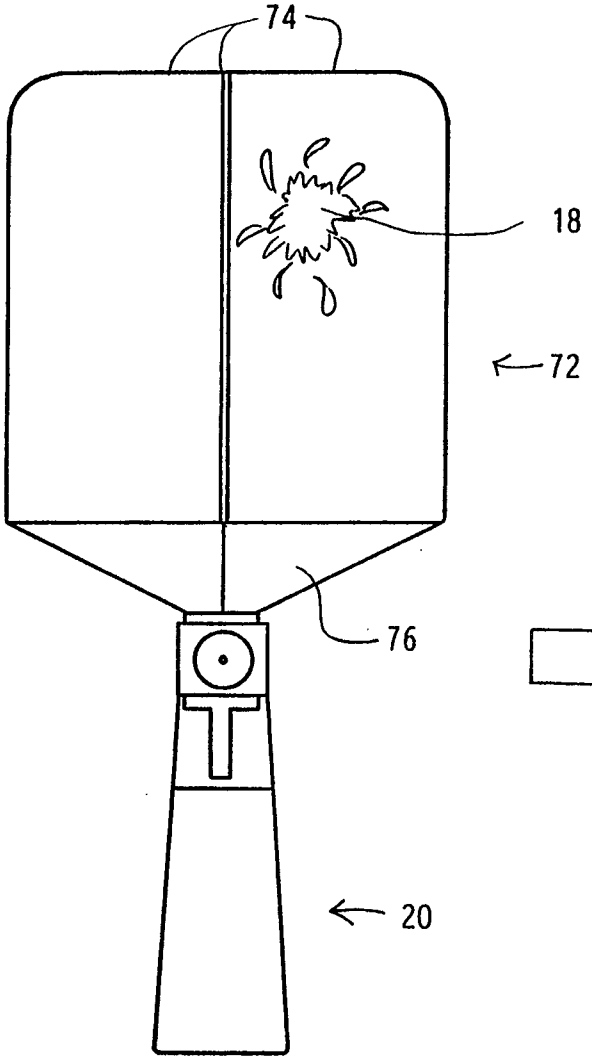
FIG. 9 shows a front view of the invention with a three dimensional target.
Figure 11:
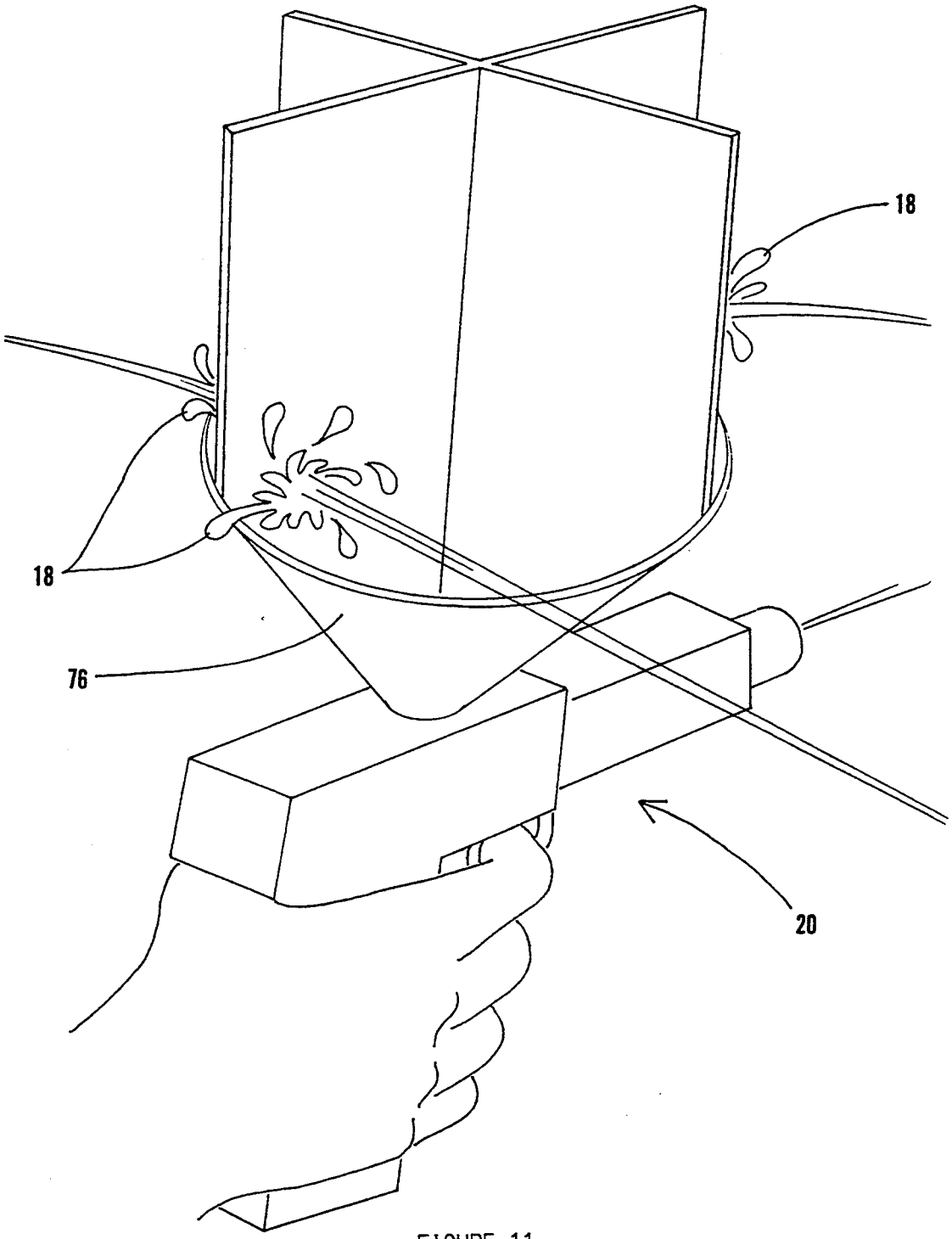
FIG. 11 shows a perspective view of the three dimensional target being used in a combat game.

The targets described thus far are all largely planar in shape and, therefore, will only register hits on the target from the front. This is good for face-to-face combat or for water pistol duels. For more realistic combat simulations it would be preferable if the targets could register hits from all different directions. FIGS. 9, 10 and 11 illustrate an embodiment of the invention which has a target that registers hits from 360 degrees around the player. FIG. 9 shows a front view and FIG. 10 shows a side view of this embodiment. Attached to the water pistol 20 is a target 72 with vertical vanes 74. The vanes 74 intercept water 18 that is shot at the target 72 from all directions. The water runs down the vanes 74 and is collected by the funnel 76 which connects to the lifeline in the water pistol 20. Four vanes 74 are preferred, but designs with as few as three vanes or more than four would also be effective. FIG. 11 shows a perspective view of this embodiment of the invention being used in a simulated combat game.

Figure 12:
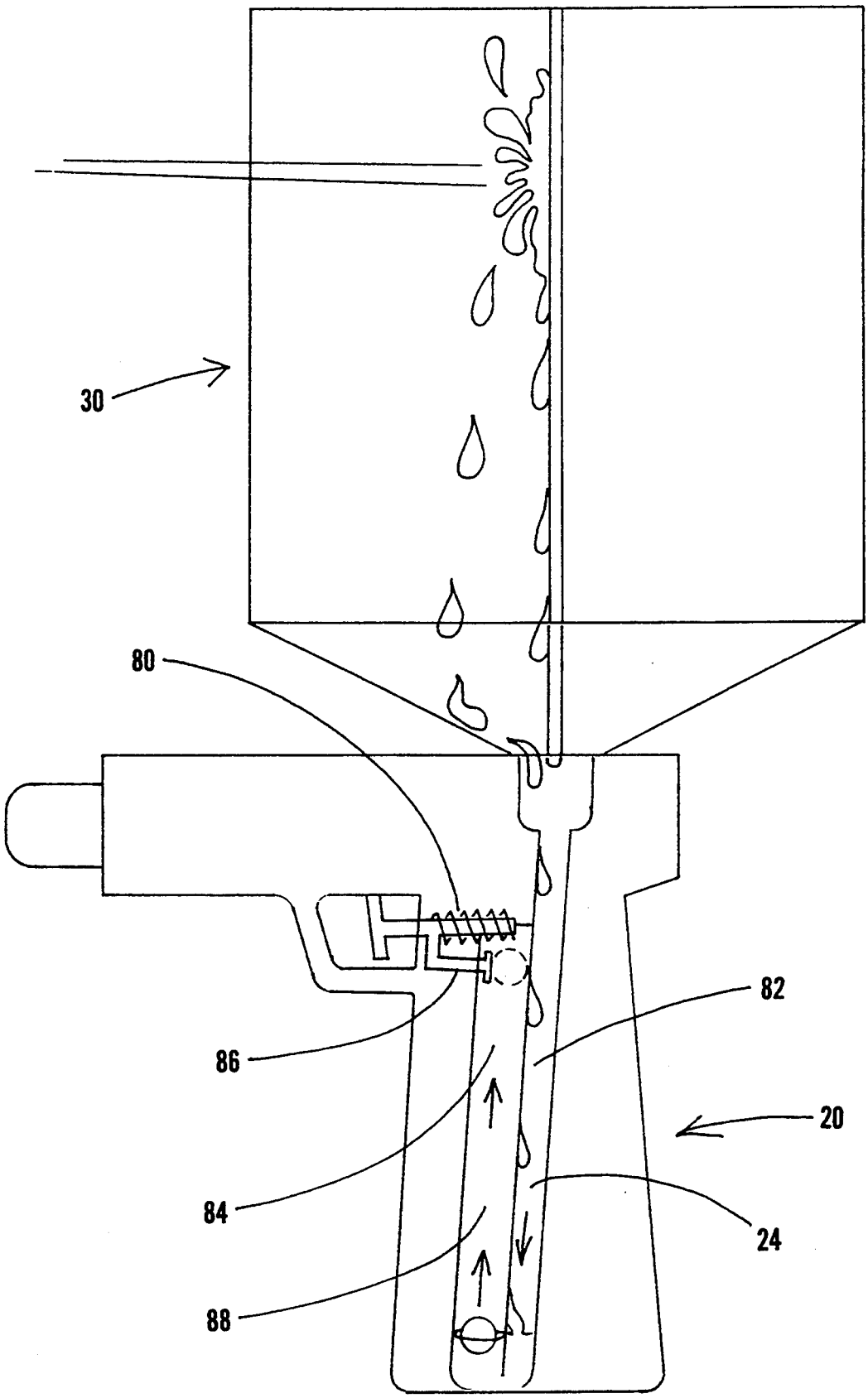
FIG. 12 shows a pistol with the three dimensional target equipped with the trigger jamming mechanism.

FIG. 12 shows an embodiment of the invention having a water pistol 20 with a three dimensional target 30 and the additional feature of a trigger jamming mechanism 80. The lifeline tube 82 within the handle 24 of the pistol 20 contains a float ball 84 which rises to the top of the float ball chamber 88 as the lifeline tube 82 fills with water. When the float ball 84 reaches the top of the float ball chamber 88 it interferes with a projection 86 attached to the trigger of the pistol 20 and prevents the pistol from firing. When the water pistol 20 is disabled from firing, it indicates that the player has exceeded his "lifeline" and the player is officially "dead" for the remainder of the game. The trigger jamming mechanism 80 is reset by emptying the water out of the lifeline tube 82.

Figures 13, 14:
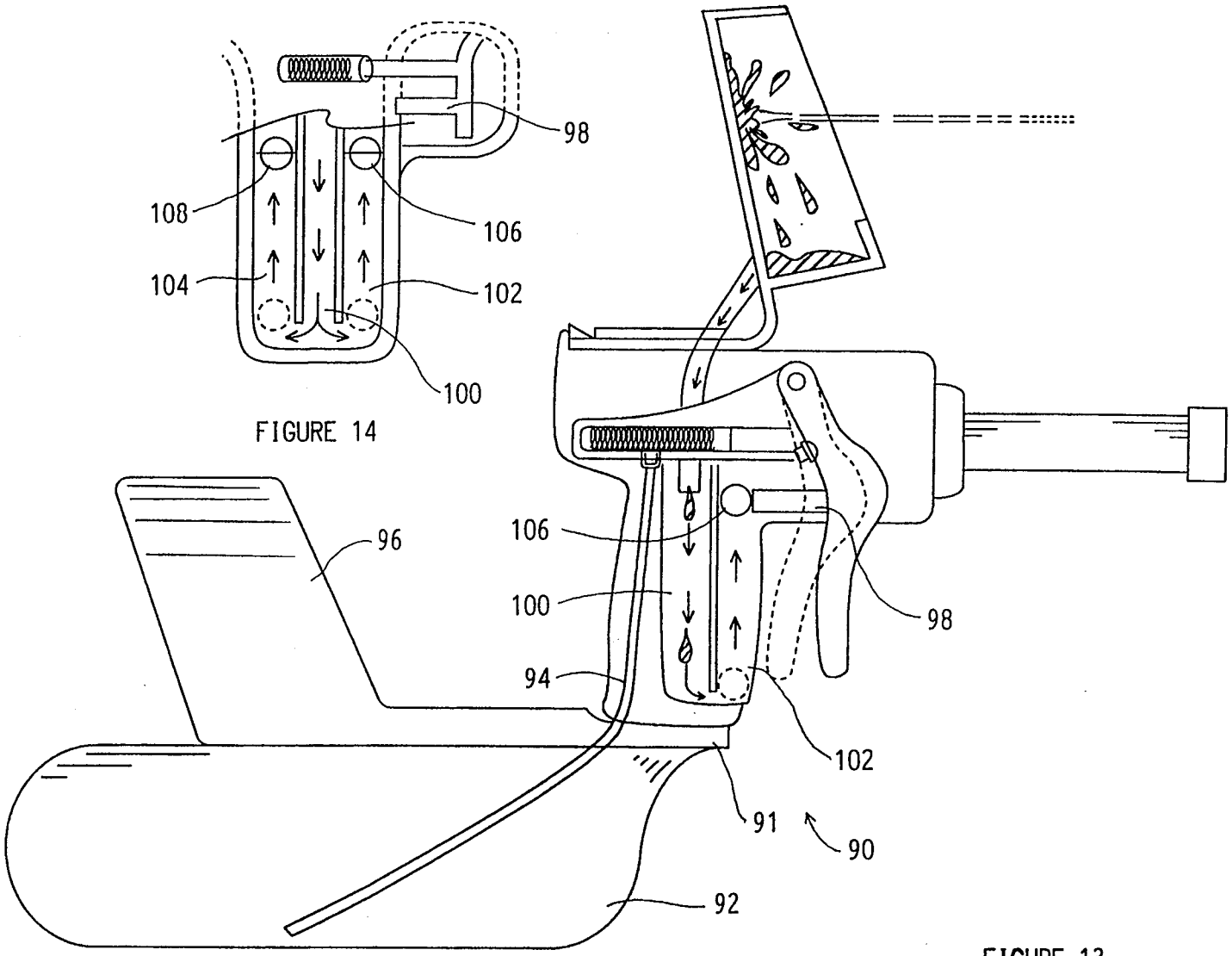
FIG. 13 shows a high capacity water pistol version of the invention equipped with an arm brace, swivel handle and the trigger jamming mechanism.
FIG. 14 shows a close-up view of one variation of the trigger jamming mechanism.

FIG. 13 shows a high volume water pistol 90 which incorporates the present invention. The water pistol 90 has a large water reservoir 92 which is connected to the pistol 90 by a tube 94. The pistol 90 is suspended on the players' arm by a ring-shaped forearm brace 96 so that it is easy to accommodate the extra weight of the large water reservoir 92 without fatigue. The pistol 90 may be pivotally or flexibly attached 91 to the water reservoir 92 or the forearm brace 96 so that it can be quickly aimed by wrist action without having to maneuver the entire water reservoir 92. The pistol 90 is designed to emit high velocity streams of water and it can be made to operate by air pressure, by a high volume hand operated pump or by a battery powered pump. The pistol 90 includes a lifeline tube 100 with a float chamber 102 which contains the float ball 106 for the trigger jamming mechanism 98. One variation on the lifeline tube 100 for the trigger jamming mechanism 98 is shown in FIG. 14. In this variation the lifeline 100 has two float chambers 102, 104, one contains the float ball 106 for the trigger jamming mechanism 98 and the second is a transparent chamber that contains a float 108 that gives the player a visual indication of how much is left of his lifeline.

Figure 15:
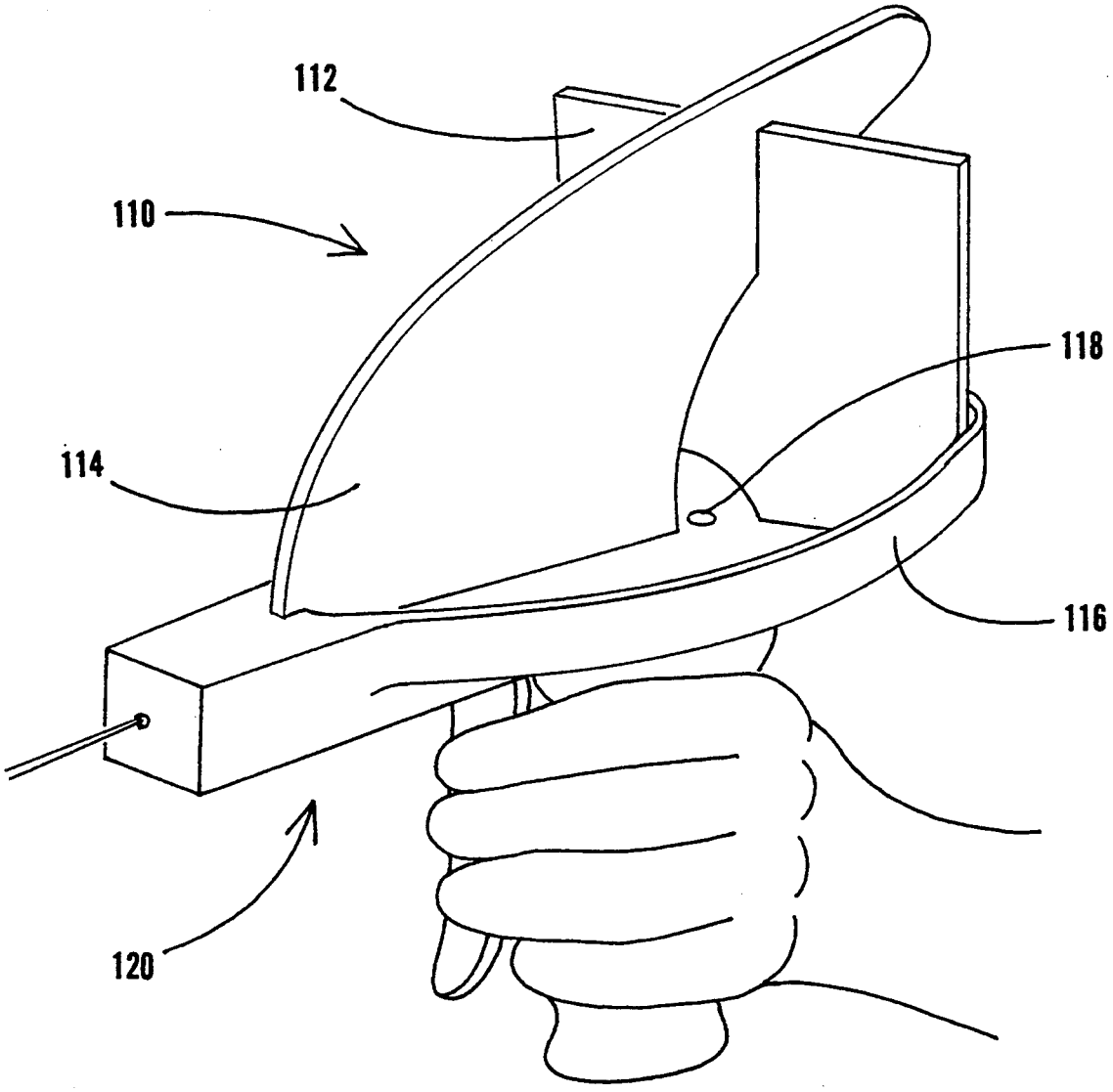
FIG. 15 shows a person using the invention with a second version of the three dimensional scoring target.

FIG. 15 shows a stylized version of the invention with the three dimensional scoring target. In this version, the target 110 has a back plate 112 and a perpendicular plate 114, which in this case is shaped like a shark fin. The target 110 can be made so that it registers hits from a 180 degree arc in front of the target 110 or it can be made to register hits from a full 360 degree arc around the target 110. Other variations of the target should be made to intercept hits from angles anywhere between zero and 360 degrees. Water that hits the plate 114 or the back plate 112 from any direction runs down and is captured by the funnel 116 which is formed integrally with the pistol 120. A hole 118 leads from the funnel 116 into the lifeline tube inside of the water pistol 120. The shark fin motif of this example is thought to be very appropriate to the theme of water pistol fights, however, the invention can be made in many other decorative motifs reflecting other animals or different kinds of weapons.

Figure 16:
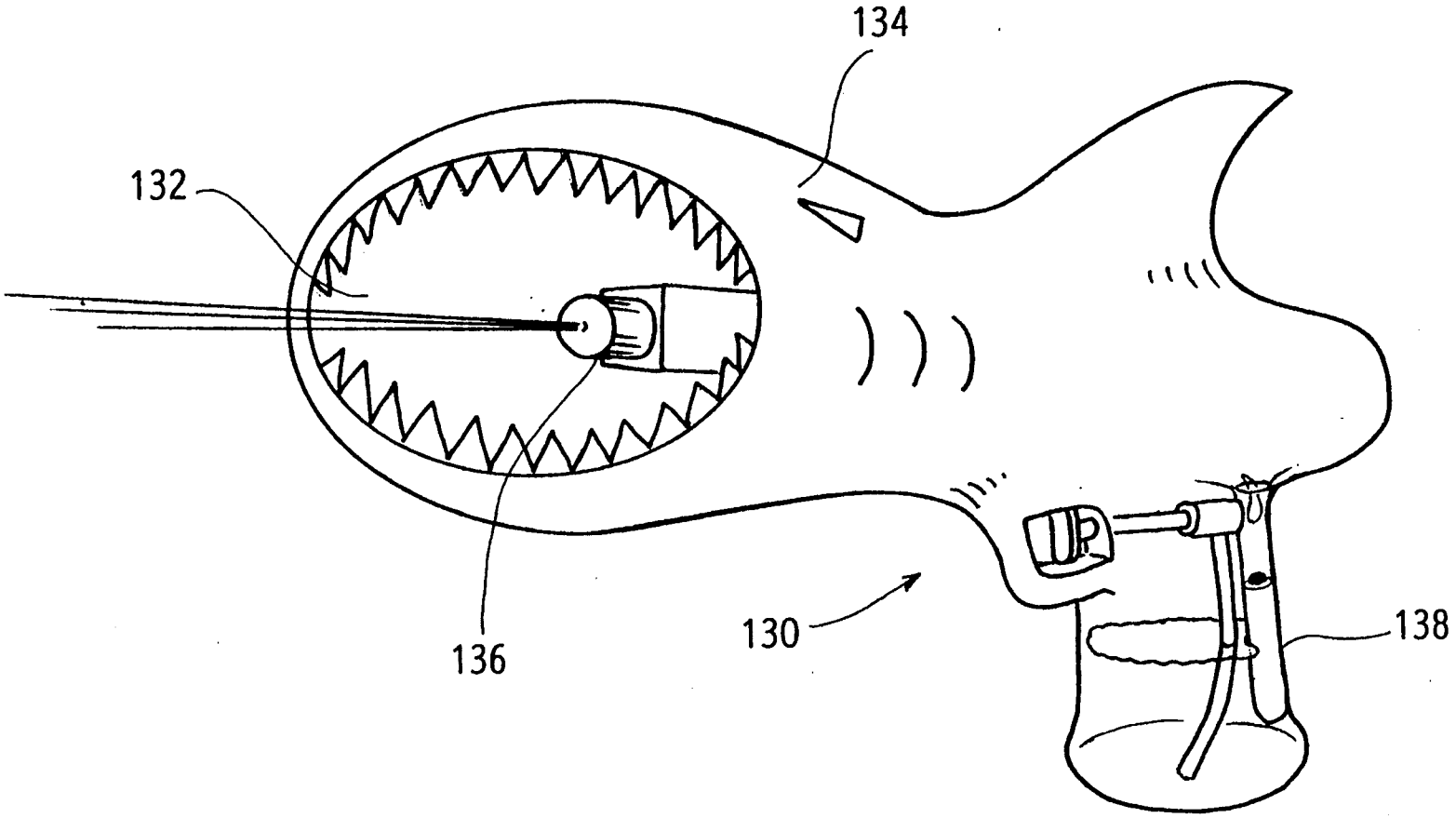
FIG. 16 shows an animal theme water pistol and scoring target.

FIG. 16 shows a stylized version of the invention with an animal theme water pistol and scoring target. In this version, the water pistol 130 and the target 132 have been integrated into the shape of an animal head or body 134. The example shown has the shape of a shark body 134. The pistol barrel 136 is located inside the head of the shark so that a stream of water will be emitted from the shark's mouth 132. The mouth 132 which surrounds the barrel also serves as the scoring target for the invention. The water which enters the shark's mouth 132 runs down into the body 134 of the shark and into the lifeline scoring tube 138.

Figure 17:
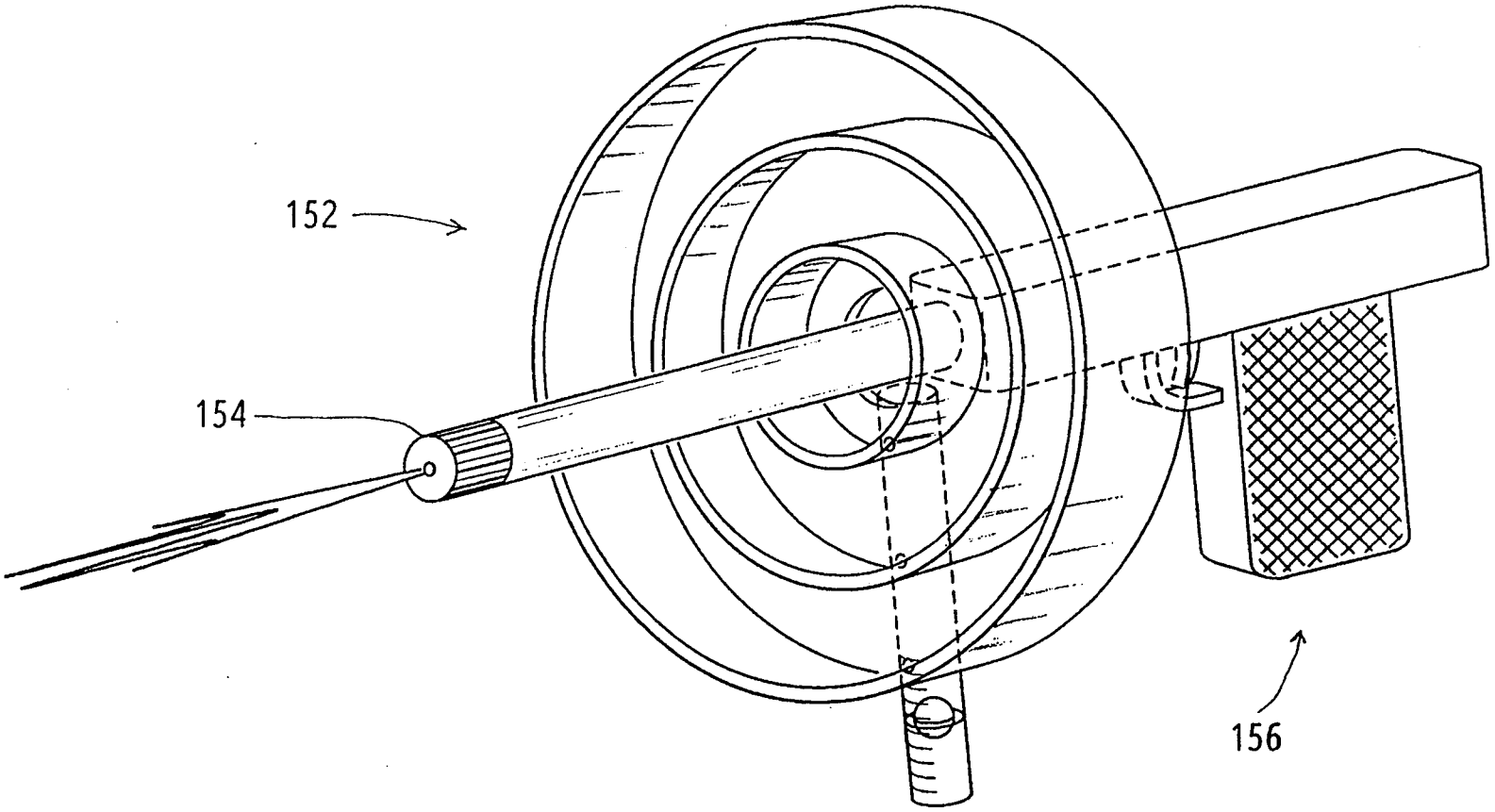
FIG. 17 shows a bull's-eye scoring target for attaching to an existing water pistol.
Figure 18:
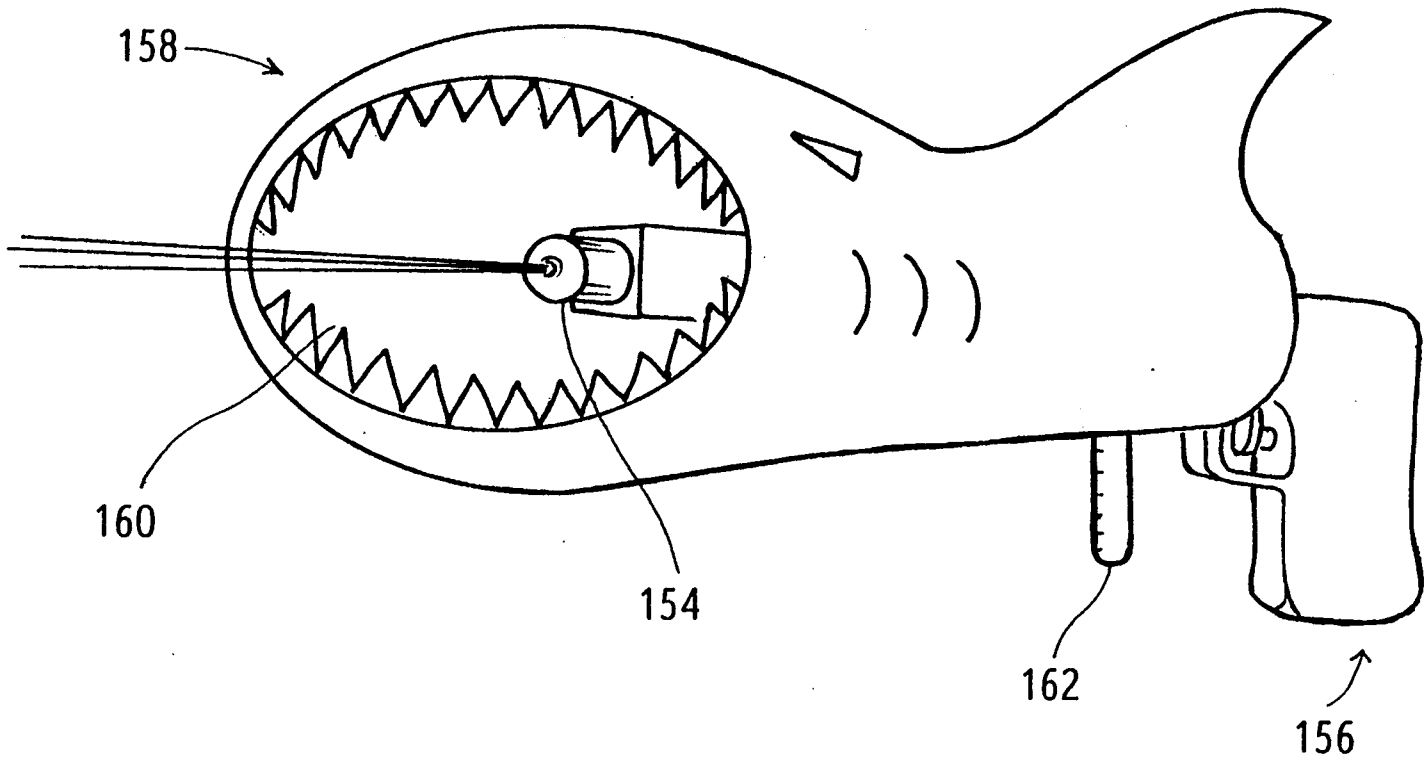
FIG. 18 shows an animal theme scoring target for attaching to an existing water pistol.

FIGS. 17 and 18 show embodiments of the bull's-eye scoring target and the animal theme scoring target that are adapted for attaching to an existing water pistol to form the combined water pistol and target of the present invention. In FIG. 17 is shown a bull's-eye scoring target 152 which fits around the barrel 154 of a water pistol 156. Because the target 152 fits concentrically around the barrel 154, the clamp which holds it to the pistol 154 can be quite simple because the weight of the target 152 is evenly balanced. FIG. 18 showns a scoring target 158 shaped like a shark's head which fits around the barrel 154 of a water pistol 156. The water which enters the shark's mouth 160 runs down into a lifeline scoring tube 162 which is attached to the target 158 rather than being integrated into the water pistol 156 as in other embodiments.

Figure 19:
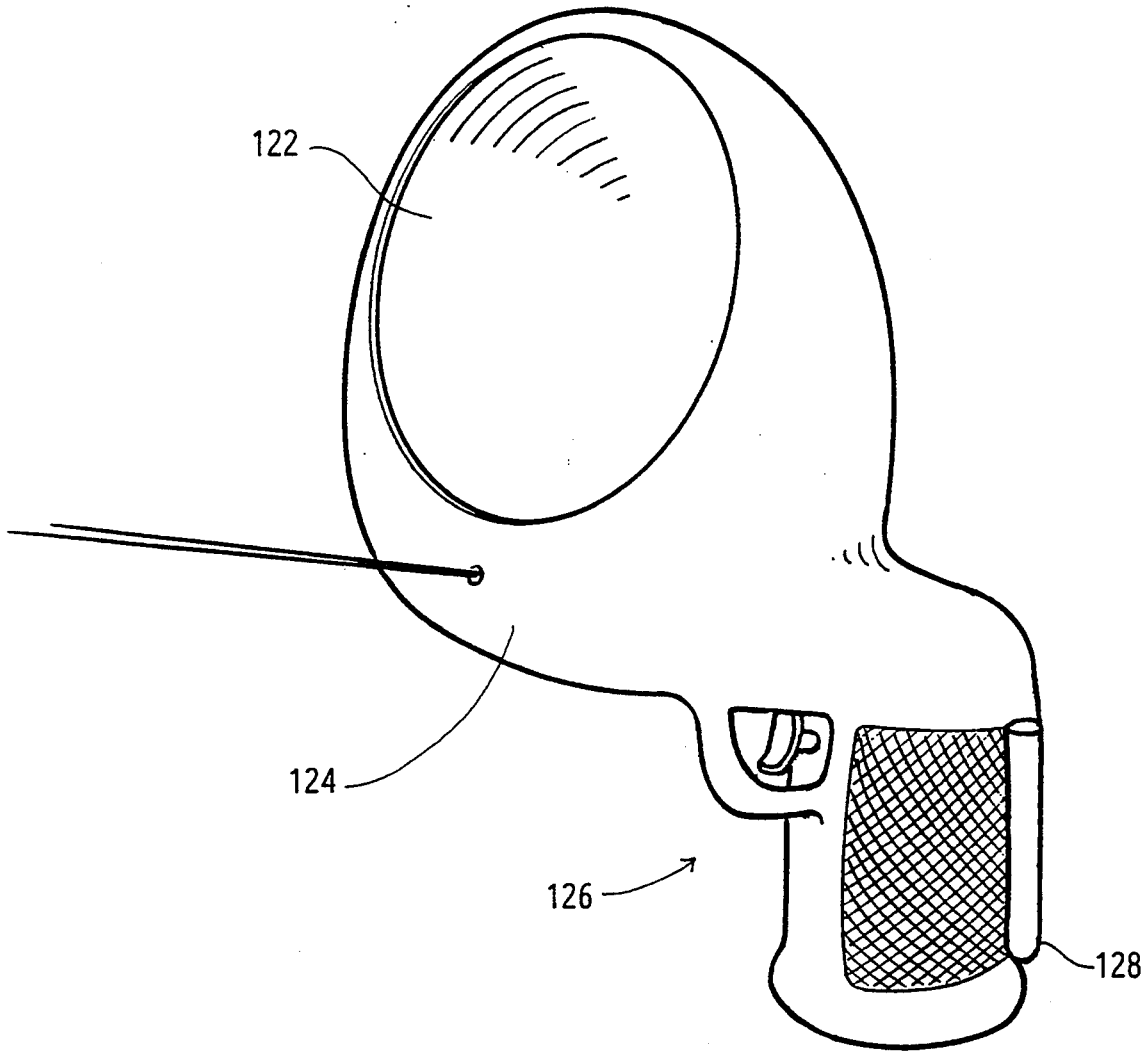
FIG. 19 shows another alternate embodiment of the invention.

FIG. 19 shows another alternate embodiment of the invention. In this variation, the water is gathered is by a large scoop-shaped target 122, which is molded integrally with the barrel 124 of the water pistol 126 and routed to the "lifeline" a scoring tube 128.

Figure 20:
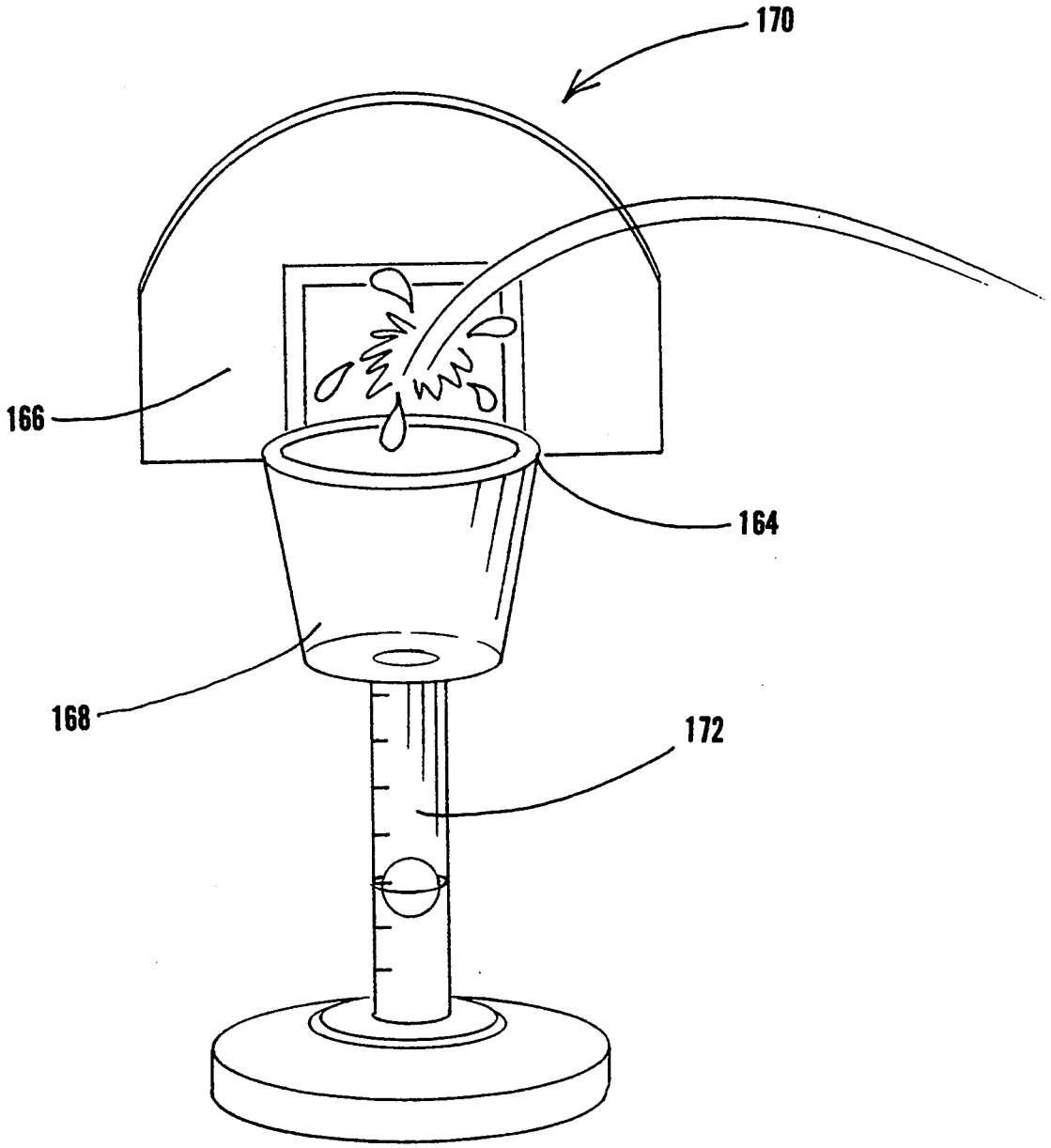
FIG. 20 shows a sports theme scoring target resembling a basketball hoop.

The scoring target of the present invention can also be made with a sports theme, such as the target in the form of a basketball hoop shown in FIG. 20. The target 170 is made such that water can be squirted directly into the basketball hoop 164 or water can be sprayed onto the backboard 166 so that it rebounds into the basket 168. The basket 168 serves as a funnel for collecting the water which runs down into a scoring tube 172, similar to the lifeline tube of previous embodiments. The scoring tube 172 shows a cumulative score analogous to the number of baskets scored in a real basketball game.

Figure 21A:
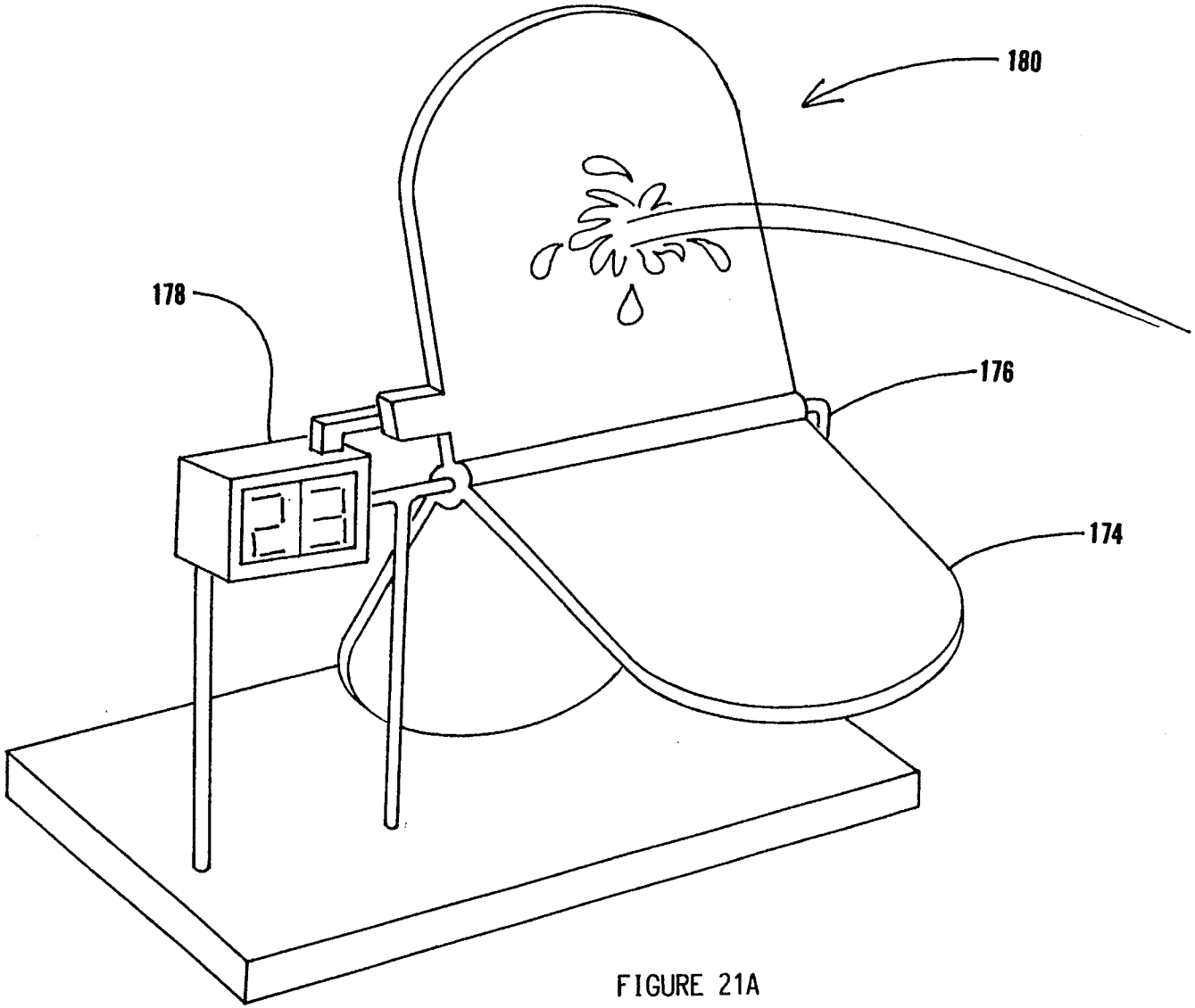
FIGS. 21 A&B show two versions of paddle wheel scoring targets.
Figure 21B:
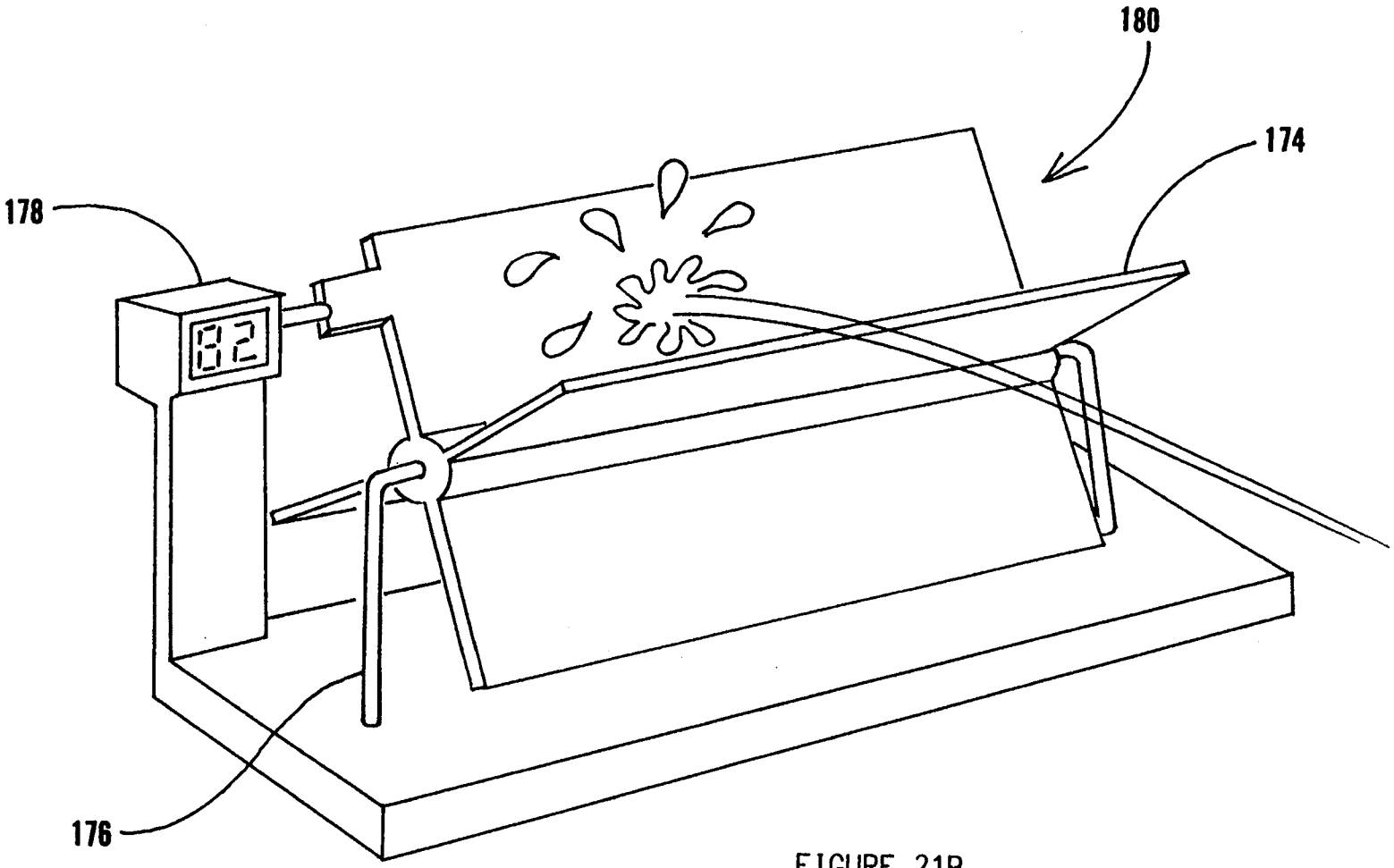
Figure 22:
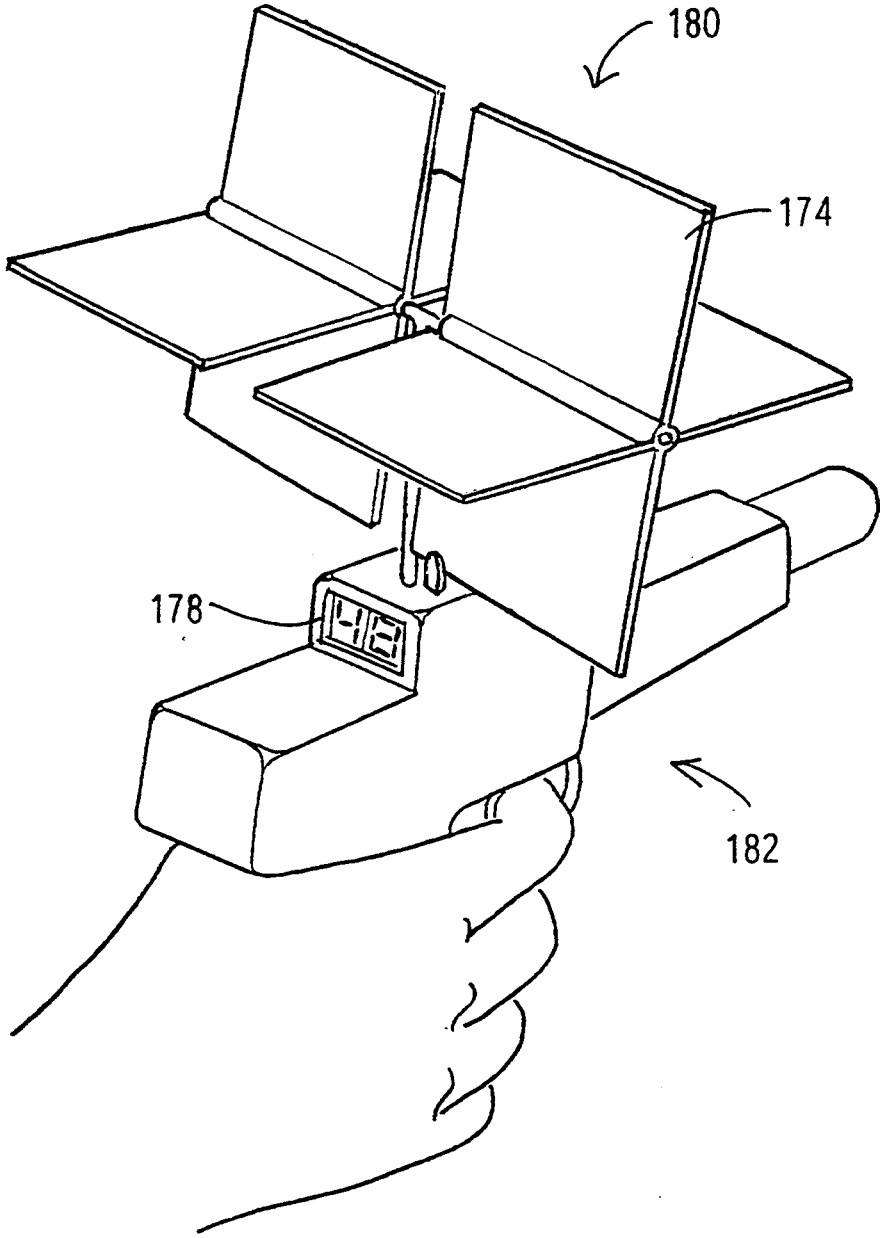
FIG. 22 shows a horizontal axis paddle wheel scoring target mounted on a water pistol.
Figure 25:
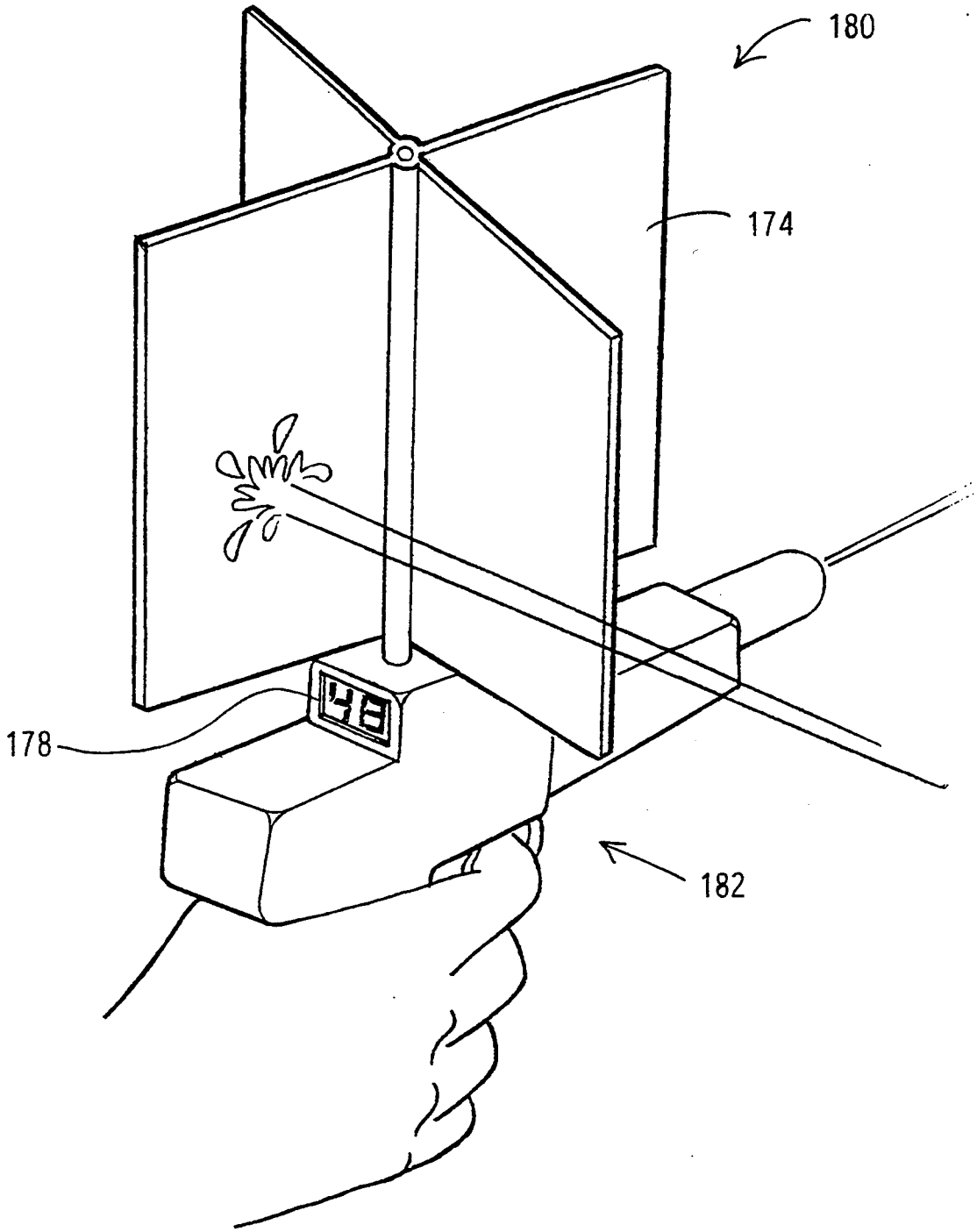
FIG. 25 shows a vertical axis paddle wheel scoring target mounted on a water pistol.

Mechanisms other than the "lifeline" tube can also be used to quantify the number of hits on the target used in the invention. FIGS. 21 A&B show two versions of paddle wheel scoring targets 180 that can be used to quantify the score of players in the game. A paddle wheel 174 or a pinwheel is rotatably mounted on a pivot 176 so that it is free to spin when it is hit with a stream of water. The axis of the pivot 176 can be horizontal or vertical or any other convenient orientation. A counter 178 counts the turns of the paddle wheel 174 and displays a quantitative measure of the score. The targets 180 can be freestanding for using in target shooting mode as shown in FIGS. 21 A&B, or the target 180 can be mounted on a water pistol 182 as shown in FIGS. 22 and 25 for combat mode. With simple changes in the counter mechanism, the paddle wheel dan be made to score points when it spins in one direction only or when it spins in either direction, or it can score positive points in one direction and negative points in the other direction for a tougher test of marksmanship, or the paddle wheel can be ratcheted so that it will spin in one direction only.

FIG. 22 shows one embodiment of the paddle wheel scoring target 180 mounted on a water pistol 182. The paddle wheel 174 is rotatably mounted on a horizontal axis. When a stream of water strikes the paddle wheel 174 it will spin and the counter 178 records the number of rotations of the paddle wheel 174 which gives a quantitative score.

FIG. 25 shows a second embodiment of the paddle wheel scoring target 180 mounted on a water pistol 182. In this case, the paddle wheel 174 is rotatably mounted on a vertical axis and the counter 178 records the number of rotations. When the paddle wheel 174 is oriented with a vertical axis and the counter is arranged to score points when the paddle wheel spins in either direction, it will have the effect of a three dimensional target which scores hits from anywhere in a 360 degree arc around the player. An advantage of this arrangement over the "lifeline" targets is that the target will still score points no matter what its orientation is with respect to gravity. Also, players cannot lessen their scores by trying to drain out the accumulated water in the target. They also cannot try to lessen their scores by spinning the target in the reverse direction because it scores points spinning either way.

Although the examples given include many specificities, they are intended as illustrative of only some of the possible embodiments of the invention. Other embodiments and modifications will, no doubt, occur to those skilled in the art. For instance, the present invention can be made in the form of a rifle or other weapon rather than a water pistol, or the firing mechanism of the gun can be motorized or pressurized for automatic operation. Thus, the examples given should only be interpreted as illustrations of some of the preferred embodiments of the invention, and the full scope of the invention should be determined by the appended claims and their legal equivalents.

I claim:

1. In combination:

a first water gun, having means for projecting a stream of water, a first scoring target, said first scoring target having at least one surface for intercepting a stream of water which originates from a source external to said first water gun, said first scoring target having a jamming means for disabling said first water gun from projecting a stream of water when said first scoring target registers a score exceeding a predetermined score, and an attachment means for attaching said first scoring target to said first water gun.

2. The combination of claim 1 wherein said attachment means comprises a means for removably attaching said first scoring target to said first water gun.

3. The combination of claim 2 further comprising a base having means for alternately attaching said first scoring target to said base.

4. The combination of claim 1 wherein said first scoring target further comprises a tube having an open end and a closed end, said open end being in fluid communication with said target, whereby when a stream of water impinges upon said at least one surface, the impinging water collects in said tube.

5. The combination of claim 4 wherein said first scoring target further comprises graduations for indicating the level of water in said tube.

6. The combination of claim 1 wherein said at least one surface comprises a plurality of surfaces for intercepting a stream of water from a plurality of directions.

7. The combination of claim 6 wherein said plurality of surfaces are arranged for intercepting a stream of water from any direction in a 180 degree arc.

8. The combination of claim 6 wherein said plurality of surfaces are arranged for intercepting a stream of water from any direction in a 360 degree arc.

9. The combination of claim 4 wherein said first scoring target further comprises a plurality of regions each of said regions being in fluid communication with said tube.

10. The combination of claim 1 further comprising:

a second water gun, having a second means for projecting a stream of water, a second scoring target, said second scoring target having at least one surface for intercepting a stream of water which originates from a source external to said second water gun, and a second attachment means for attaching said second scoring target to said second water gun, wherein said first scoring target is adapted to intercept a stream of water from said second water gun and said second scoring target is adapted to intercept a stream of water from said first water gun.

11. In combination:

a water gun, having means for projecting a stream of water.

a scoring target, said scoring target having at least one surface for intercepting a stream of water, and an attachment means for attaching said scoring target to said water gun, wherein said scoring target further comprises a tube having an open end and a closed end, said open end being in fluid communication with said target, whereby when a stream of water impinges upon said at least one surface, the impinging water collects in said tube, and wherein said scoring target further comprises a jamming means for disabling said water gun from projecting a stream of water when said tube is filled with water.

12. The combination of claim 11 wherein said water gun comprises a trigger and wherein said jamming means comprises a float within said tube, said float moving into a position where said float interferes with said trigger when said tube is filled with water.

* * * * *